United States Patent [19]

Lee

[11] Patent Number: 4,928,775

[45] Date of Patent: May 29, 1990

[54] DOWNHOLE SURGE VALVE FOR EARTH BORING APPARATUS

[75] Inventor: Douglas W. Lee, Enid, Okla.

[73] Assignee: Gas Research Institute, Chicago, Ill.

[21] Appl. No.: 292,243

[22] Filed: Dec. 30, 1988

[51] Int. Cl.[5] ..... E21B 4/14; E21B 21/10

[52] U.S. Cl. ..... 175/19; 166/334; 175/93; 175/94; 175/232; 175/234; 175/296; 175/317; 175/321; 175/324; 251/347

[58] Field of Search ..... 175/234, 235, 232, 317, 175/318, 321, 324, 296, 19, 21, 92, 93, 94; 166/332, 334; 251/319, 343, 344, 347; 173/58, 91

[56] References Cited

U.S. PATENT DOCUMENTS

| | | | |
|---|---|---|---|
| 1,706,072 | 3/1929 | Rieger | 175/232 |
| 1,807,837 | 6/1931 | Fortune | 175/317 |
| 2,311,212 | 2/1943 | Coberly | 251/347 X |
| 2,856,009 | 10/1958 | Foster | 166/334 |
| 2,858,099 | 10/1958 | Althouse, Jr. et al. | 251/347 |
| 3,148,732 | 9/1964 | Gage | 166/334 |
| 3,593,786 | 7/1971 | Lewis | 166/222 |
| 3,642,249 | 2/1971 | Cruse | 251/344 |
| 3,731,716 | 5/1973 | Darish | 141/117 |
| 4,019,592 | 4/1977 | Fox | 175/234 |
| 4,022,427 | 5/1977 | Read | 251/343 |
| 4,214,638 | 7/1980 | Sudnishnikov et al. | 173/91 X |
| 4,249,611 | 2/1981 | Zijlstra | 166/367 |
| 4,632,191 | 12/1986 | McDonald et al. | 175/19 |
| 4,693,316 | 9/1987 | Ringgenberg et al. | 175/321 X |
| 4,694,913 | 9/1987 | McDonald et al. | 175/61 |

FOREIGN PATENT DOCUMENTS

| | | | |
|---|---|---|---|
| 563083 | 9/1958 | Canada | 251/343 |
| 723453 | 12/1965 | Canada . | |

OTHER PUBLICATIONS

Microtunnelling, Autumn, 1986, pp. 18–21.

Russian language advertisement, undated.

"Sewer Mole Cracks into Steady Routine", Underground, Jul. 1986, pp. 18–21.

*Primary Examiner*—Hoang C. Dang

*Attorney, Agent, or Firm*—Banner, Birch, McKie & Beckett

[57] ABSTRACT

A manually operated downhole for an underground earth boring apparatus having a pneumatically operated earth boring tool. A drill pipe is connected to the tool and to a source of pneumatic fluid. A valve is positioned in the drill pipe substantially adjacent to the tool between the tool and the source of pneumatic fluid. This downhole valve controls the flow of pneumatic fluid to the tool. The valve is operable in response to pushing or pulling on the drill pipe.

3 Claims, 4 Drawing Sheets

DOWNHOLE SURGE VALVE FOR EARTH BORING APPARATUS

FIELD OF THE INVENTION

This invention relates generally to control valves for pneumatic earth boring tools. More particularly, the invention relates to a downhole, manually operated control valve which provides a high energy starting pulse of working fluid to facilitate operation of an impact type earth boring tool.

BACKGROUND OF THE INVENTION

Underground boring technology is well-known and commonly used for a variety of applications. It is an accepted and frequently used method for installing underground utilities under roadways, rail beds, lawns, fences, and other surface obstructions. Underground boring is a desirable alternative to digging an open trench, particularly in developed areas.

A variety of boring tools are available, including rotary flexible rod devices, auger devices, pipe pushers, and air of hydraulic powered impact type earth boring tools (also known as percussive moles). Directional boring systems also have been developed which let the operator control and monitor the path of an underground boring tool.

A conventional boring tool assembly includes a drilling frame or rig, sections of drill pipe or flexible hose, and a boring tool. The boring tool may include a steering assembly and tracking instrumentation. Hydraulic power generally is used to control various functions of the drilling frame, while compressed air generally is used to operate the boring tool. Typically, compressed air is supplied through the drill pipe or by a flexible hose. The boring tool may be a drilling motor driving a cutting bit to drill through rock or a percussive mole for compacting a bore hole in soil. The present invention has particular applicability to pneumatically powered percussive moles in which compressed air is provided to the percussive by the drill pipe rather than a flexible hose.

As the percussive mole progresses away from the drilling frame, additional sections of drill pipe are added between the boring tool and the drill frame. The successive lengths of drill pipe are generally referred to as comprising a drill string. As each section of drill pipe is added to the drill string, air flow to the tool must be interrupted and the drill string emptied of air pressure. This is normally accomplished by a valve on the drilling frame which opens and closes the supply of compressed air. Once the connection of another section of drill pipe is completed, the air flow to the tool can be initiated by opening the compressed air valve on the drilling frame.

The increasing length of the drill string is, in effect, forming an increasingly long expansion chamber. Expansion of the compressed air entering the empty drill string drastically reduces the initial air pressure and energy potential available to start the tool in operation at the end of the drill string. This energy potential builds up slowly because of a limited or fixed capacity for generating compressed air entering the lengthened drill pipe. Since most job site air compressors have small air tanks, the time required to fill the pipe increases as the length and/or diameter of pipe increases. If pressure build-up inside the tool is slow, pressure leaks in the system preclude reaching start-up pressures and the tool will not start.

Percussive moles, in particular, require a certain surge of energy to initiate operation because of hammer inertia, internal friction, and leakage. This may be further aggravated by ineffective lubrication or frost conditions from air expansion within the tool. In cold atmospheric conditions, a percussion mole may freeze moisture in the tight seal areas. Accordingly, in order to overcome the difficulties of starting a percussive mole at the end of an increasingly long drill string, it is desirable to provide a high energy starting pulse of compressed air to the tool.

In a pending, related application entitled "Earth Boring Apparatus with Control Valve", Serial No. 136,401, filed Dec. 22, 1988, now the U.S. Pat. No. 4,834,193, there is disclosed a downhole pressure operated valve assembly designed to provide a high energy starting pulse of compressed air to a downhole tool. The valve is positioned "down the hole," that is, adjacent the tool. The valve disclosed in the U.S. Pat. No. 4,834,193 is operable in response to the pressure of the working fluid, i.e., compressed air, in a drill string or flexible conduit. As the flow of working fluid is supplied to the downhole tool, the downhole valve disclosed in the U.S. Pat. No. 4,834,193 is kept closed until a predetermined pressure is reached, at which time the valve is opened and a pulse of working fluid is supplied to the downhole tool. The valve is kept open until the pressure drops to a second predetermined pressure, substantially lower than the first predetermined opening pressure, at which time the valve in the U.S. Pat. No. 4,834,193 is closed. This valve, however, requires that the opening and closing pressures be predetermined. This does not provide the flexibility to vary the pressures at which the valve is opened or closed to thereby accommodate a variety of operating conditions.

Articles on page 18 in the Autumn 1986 issue of MICROTUNNELING magazine and on page 18 of the July 1986 issue of UNDERGROUND magazine mention a percussive hammer having an electrically operated downhole solenoid valve connected to the hammer. This solenoid valve is manually operated to provide the kick or boost required to get the percussive equipment moving properly. However, this valve requires a separate supply of electric power and an additional supply line in the bore hole to provide electric power to the downhole valve.

SUMMARY OF THE INVENTION

The present invention overcomes the problem of prior known downhole control valves, such as disclosed in Serial No. 136,401, by providing a manually operated downhole valve for controlling the flow of a working fluid to a percussive mole. The present invention is installed in the drill string of penumatic operated percussive mole and allows an above ground operator to provide an instantaneous, high-pressure blast of air to the downhole percussion tool to overcome the difficult problem of starting a percussive mole at the end of a long drill string. Unlike the valve disclosed in Serial No. 136,401, the valve of the present invention is not intended to be used with a flexible conduit supplying the working fluid. The valve of the present invention requires a rigid actuating device, such as the drill string, in order to operate the mechanical push/pull type valve of the invention.

In the present invention, the above-ground operator determines the pressures at which the downhole valve will be opened or closed. In a preferred form of the invention, the valve is opened by pushing on the drill string. The valve is closed by pulling on the drill string. Thus a wide variety of differing operating conditions can be readily accommodated using the control valve of the present invention.

The control valve of the present invention is attached at one end to a percussive mole and at the other end to a drill string of an underground boring tool assembly. The other end of the drill string is adapted to be connected to a source of working fluid, such as compressed air. The drill string is generally connected to a drill frame carriage which is operable to support and push sections of drill pipe into the earth. The drill frame carriage also permits the addition of sections of drill pipe as the drilling progresses through the earth.

The control valve of the present invention comprises a generally cylindrical valve spool. One end of the spool is open, the other end is closed. An axial bore extends part way through the valve spool. A radial passage is formed in the valve spool adjacent the closed end and communicates with the valve spool axial bore. An axial groove is formed in the peripheral sidewalls of the valve spool to accommodate a key element, as will be explained below.

The valve spool fits within an axial bore extending through a valve body. The valve spool is axially movable within the valve body. Seal means, such as wear rings fixed within the axial bore of the valve body, are provided for closing and opening the radial passage in the valve spool when the spool is moved axially with respect to the valve body.

The valve body includes an axial slot which is positioned adjacent and mates with the axial groove in the valve spool. However, the axial groove in the valve spool extends axially beyond, i.e., is longer than, the axial slot in the valve body.

A free-floating key element fits within the axial groove of the valve spool and axial slot of the valve body. The key element has an axial extent less than the axial exent of the axial groove in the valve spool so that the key element and the slot and groove arrangement allow the valve spool limited axial movement within the valve body.

A tubular valve housing surrounds the valve body and covers the axial slot in the valve body to thereby retain the free-floating key element within the valve body axial slot.

In operation, the control valve of the present invention is fixed between the drill string and a percussive mole, substantially adjacent to the mole. The valve is actuated by pushing or pulling on the drill string with the drill frame carriage. When the carriage pulls back on the drill string the valve spool moves axially with respect to the main body of the valve until the keys engage the far end of the slots in the valve spool. In this position, the radial passage in the valve spool will be covered by the wear rings in the valve body, thus closing the valve to the passage of the working fluid. The friction of the percussion tool on the borehole wall is normally sufficient to develop adequate tension in the drill string to allow the valve spool to move relative to the valve body and thus close the control valve of the invention upon application of a moderate pulling force. However, the valve is structurally sound enough to transmit the maximum pulling capability of the drill frame to the percussion tool in the event the percussion tool must be retracted from the bore hole.

With the downhole valve and the compressed air valve on the drilling frame in the closed position, an additional section of drill pipe is added to the drill string. The supply of compressed air can then be continued. The compresed air valve on the drilling frame is opened, while the downhole valve adjacent the mole is kept closed. After the drill string is charged with air, and a sufficient pressure is reached, pushing forward on the drill string with the drill frame causes the valve spool of the downhole valve to move forwardly with respect to the valve body, which thereby uncovers the radial passage in the valve spool and allows a high pressure surge of compressed air to reach the percussion tool, thereby facilitating the start of its operation. This sequence of operation is repeated at the end of each piece of drill pipe as the percussion tool advances along the bore path.

DETAILED DESCRIPTION OF THE PREFERRED EMBODIMENT

Figure 1:
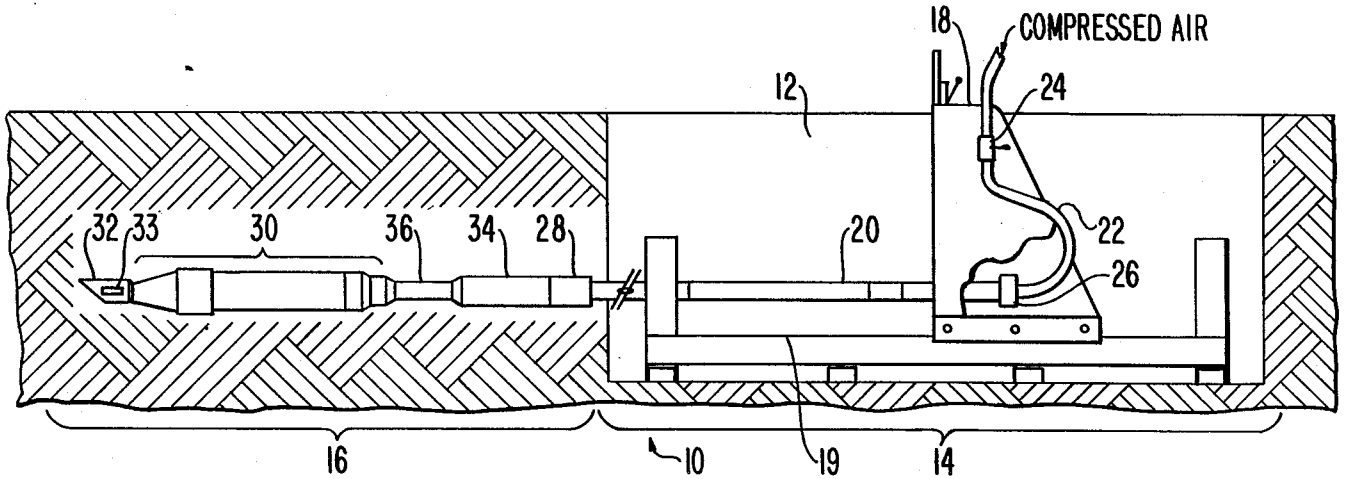
FIG. 1 is a schematic drawing, partially in section, showing horizontal boring using the present invention from a recesed pit containing a boring tool assembly.

FIG. 1 shows a schematic view of a percussive downhole tool or mole in a boring tool assembly, generally designated 10. Assembly 10 is shown as being launched from a launching pit 12. As is well-known in the art, surface launching or other techniques may be used also. Assembly 10 includes a drill frame 14 and a tool system, generally designated 16. Drill frame 14 includes a carriage assembly 18, which is operable to support and push sections of drill pipe 20 into the earth and permits additional sections of drill pipe to be added to the drill string as the drilling progresses.

Drill pipe 20 is connected to a source of compressed air, such as by a flexible conduit 22. An air swivel 26 connects flexible conduit 22 to the drill pipe 20. Various drilling assembly controls are provided including an on/off valve 24 for the source of compressed air.

The downhole control valve of the present invention is shown generally in FIG. 1 at 28. The valve is connected at one end to drill pipe 20 and at the other end to a percussive mole shown generally at 30. Percussive mole 30 may have a slant nose steering device 32 for control guidance. Mole 30 may also include components 33 for tracking the underground mole. A shock absorber device 34 and a flexible sub 35 may be positioned between control valve 28 and percussive mole 30. In general, percussive mole 30 is a conventional percussive mole as shown in U.S. Pat. Nos. 4,632,191 or 4,694,913.

Carriage assembly 18 is generally powered by a source of hydraulic fluid, not shown, and moves along track 19 to thereby push drill pipe 20 and the attached downhole tool system 16 through the earth. Drill frame 14 may also impart a rotary motion to tool system 16. Once the entire length of drill pipe 20 is pushed into the earth, carriage assembly 18 is retracted, another length of drill pipe 20 is added, and the process is repeated. As each section of drill pipe 20 is added to the drill string, air flow to the tool must be interrupted using valve 24. Once the connection of another section of drill pipe is completed, air flow to the percussive mole 30 is again supplied by opening valve 24. However, as the length of the drill string increases, the air pressure and energy potential available to start the percussive mole 30 is reduced significantly. Downhole valve 28 provides an effective control so that percussive mole 30 will receive a sufficiently high energy starting pulse of air to ensure start-up.

Figure 2:
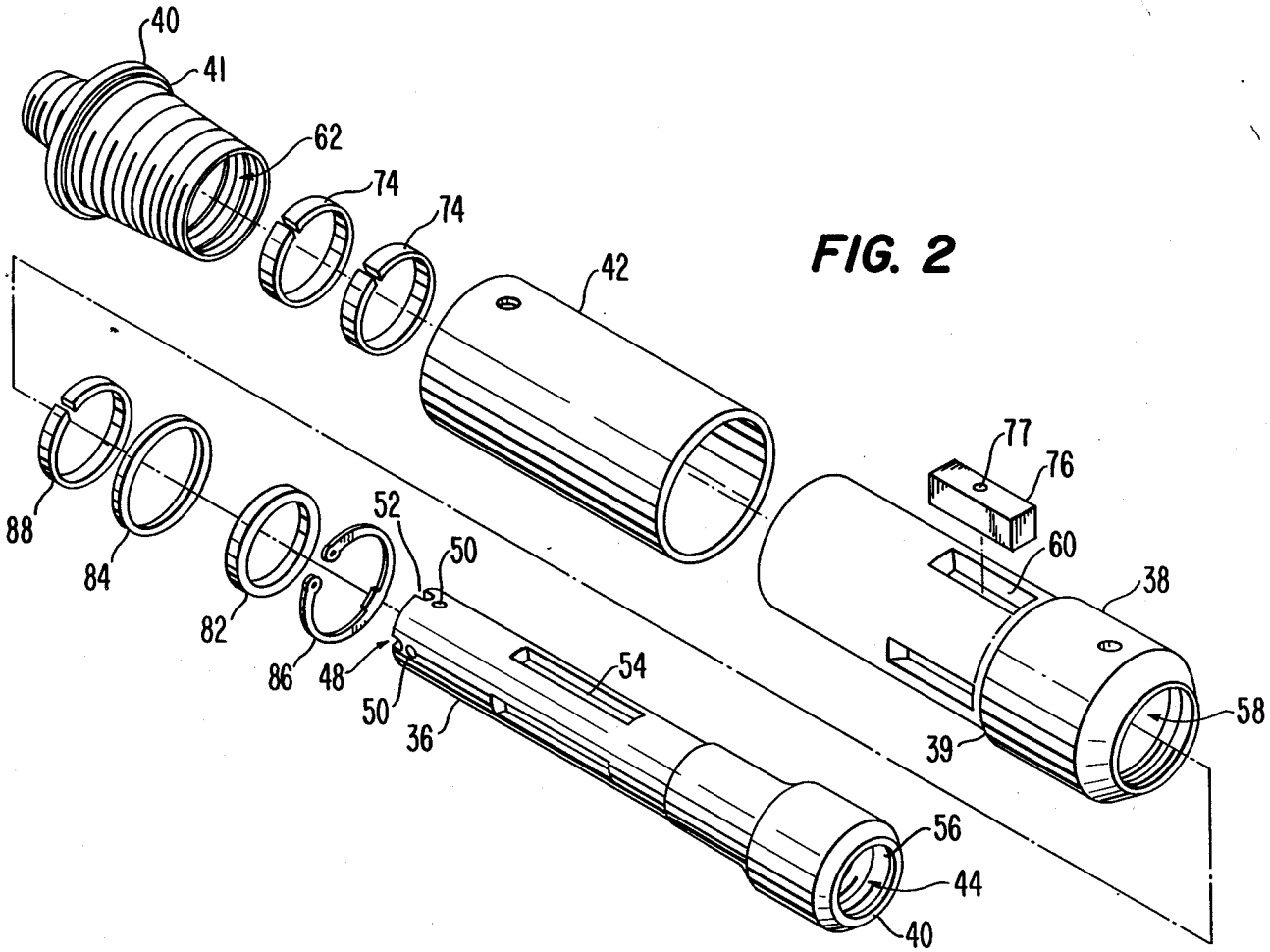
FIG. 2 is an exploded perspective view of the control valve of the present invention.
Figure 3:
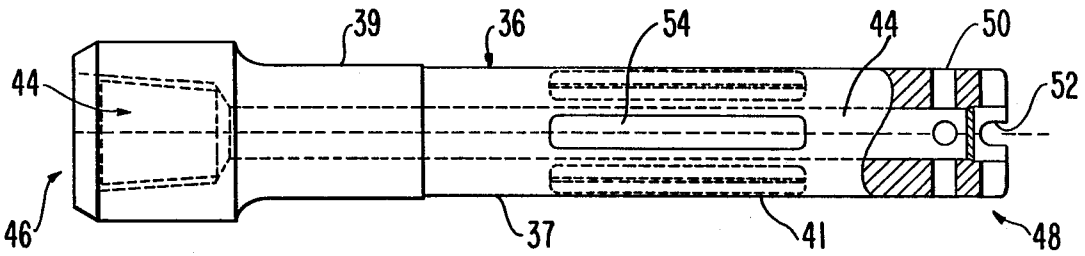
FIG. 3 is a top plan view of the valve spool used in the conntrol valve of the present invention.
Figure 4:
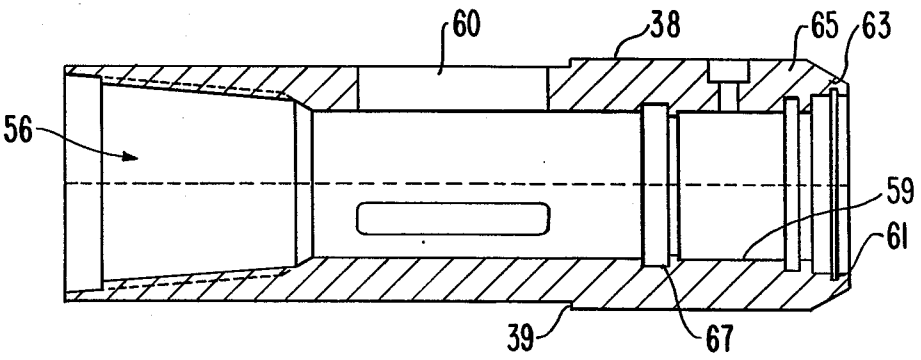
FIG. 4 is a side plan view of the valve body used in the control valve of the present invention.
Figure 5:
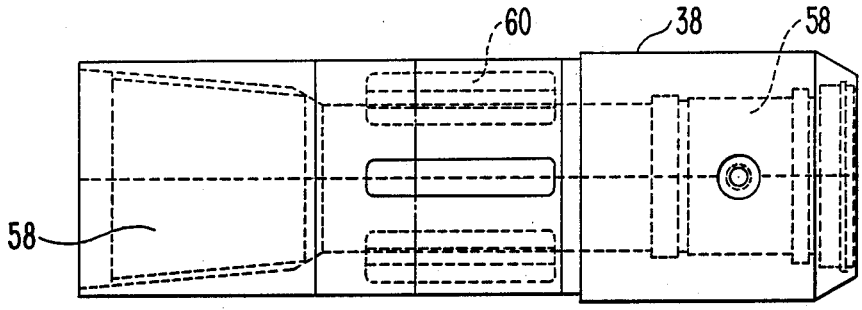
FIG. 5 is a top plan view of the valve body shown in FIG. 4.
Figure 6:
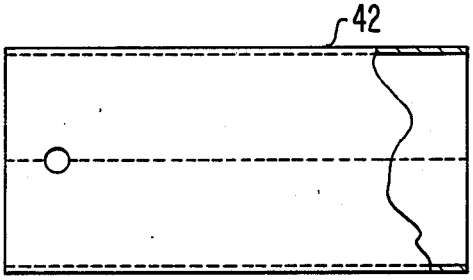
FIG. 6 is a top plan view of the valve housing of the control valve of the present invention.

FIG. 2 shows an exploded perspective view of downhole valve 28. Downhole valve 28 comprises a valve spool 36 which is axially slidable within a valve body 38. Valve body 28 has an end piece 40. Valve body 38 fits within a tubular valve housing 42.

Valve spool 36 has an axial bore 44 extending partly therethrough. Thus, valve spool 36 includes an open first end 46 and a closed second end 48. A radial passage 50 is positioned adjacent the closed second end 48 of valve spool 36. Radial passage 50 extends radially from axial bore 44 through the peripheral sidewall of valve spool 36. Closed end 48 of valve spool 36 may also include slots 52 to facilitate the flow of working fluid, as will hereinafter be described in detail.

Valve spool 36 includes a plurality of axial grooves or keyways 54. Grooves 54 do no extend completely through the sidewall of spool 36. Thus grooves 54 do not communicate with axial bore 44. Open end 46 of valve spool 36 may be threaded, as shown at 56, for attachment to drill pipe 20.

The outer peripheral wall 37 of spool 36 has a seal portion 39 having a finished or chromed surface. Seal portion 39 has an outer diameter slightly larger than the outer diameter of the main body 41 of the spool. As will be described below, seal portion 39 provides a sealing surface for valve seals.

Valve body 38 is generally cylindrical and includes an axial bore 58 extending through the valve body. As shown in FIG. 2, when the control valve 28 is assembled, valve spool 36 extends through axial bore 58 of valve body 38. Valve body 38 includes a plurality of axial slots 60. Axial slots 60 of valve body 38 are positioned adjacent and mate with axial grooves 54 of valve spool 36 when control valve 28 is assembled. However, axial grooves 54 in valve spool 36 extend axially beyond axial slots 60 of valve body 38 i.e., grooves 54 are longer than slots 60.

The inner wall 59 of valve body 38 has a plurality of grooves 61, 63, 65 and 67 for purposes to be described below.

Figure 7:
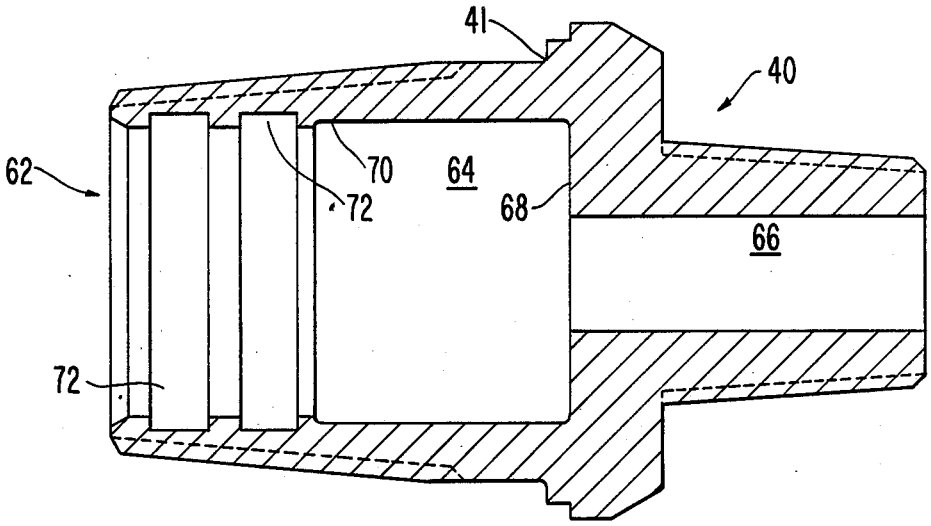
FIG. 7 is a cross sectionnal view of one end of the valve body of the control valve of the present invention.

Valve body 38 includes an end piece 40, which, as shown in FIG. 2, may be formed separately from valve body 38 and be affixed thereto. End piece 40 includes an axial bore 62 extending therethrough. Axial bore has a first section 64 and a second section 66. A shoulder 68 provides the transition between section 64 and section 66, as shown clearly in FIG. 7. Also as shown in FIG. 7, the first section 64 of axial bore 62 is enlarged with respect to the second section 66. Additionally, the inner wall 70 of bore 64 includes grooves 72 into which fit wear rings 74.

A free-floating key element 76 fits within axial grooves 60 of valve body 38 and extends into axial slots 54 of valve spool 36. Key element 76 has an axial extent substantially equal to the axial extent of axial slot 60 in valve body 38 and thus less than the axial extent of axial grooves 54 in valve spool 36. Since key elements 76 are shorter than grooves 54, key elements permit the valve spool limited axial movement within the valve body. A bore 77 through the key element may be provided to facilitate removal of the key element from the valve assembly, if necessary.

Tubular housing 42 fits over valve body 38 and is retained between a shoulder 39 on valve body 38 and a corresponding shoulder 41 on one piece 40. Housing 42 covers axial slots 60 in valve body 38 and serves to retain key elements 76 within axial slots 60.

When control valve 28 is assembled, valve spool 36 fits within axial bore 58 of valve body 38, and valve body 38 fits within the axial bore of tubular housing 42. Wear rings 74 fit within grooves 72 on the inner surface of end piece 40. Key elements are retained in axial grooves 54 and axial slots 60. Seals 82 and 84 are assembled into groove 63, 65 on the inner wall 59 of bore 58 in valve body 38. Seals 82, 84 sealingly engage seal portion 39 of valve spool 36. Snap ring 86 fits within groove 61 on the inner wall 59 of bore 58 and retains seal 82 in place. In addition, an additional wear ring 88 fits within groove 67 on the inner wall 59 of bore 58 in valve body 38 and serves to centralize valve spool 36 within valve body 38 to ensure that there is radial clearance between radial passage 50 and the peripheral sidewalls of first section 64 of axial bore 62 in end piece 40. End piece 40 is threaded for attachment to a percussive tool.

The operation of the tool will now be described. Upon opening surface valve 24, compressed air is provided to drill string 20 through flexible conduit 22. Downhole valve 28 is initially closed. Working fluid passes through the drill string into the central bore of control valve 28 but is prevented from reaching percussive tool 30 since valve 28 is closed. Thus, compressed air fills the drill string until the drill string is charged to the appropriate pressure. Pushing forward on drill string 20 with carriage 18 causes valve spool 36 to move forwardly and axially with respect to valve body 38 so that radial passage 50 on valve spool 36 passes the last wear ring 74 in end piece 40. In this configuration the radial clearance between valve spool 36 and the first section 64 of axial bore 62 in end piece 40 is such that compressed air is allowed to pass through the bore in end piece 40 and initiate operation of mole 30. When the carriage assembly has pushed an entire length of drill string 20 into the earth, compressed air valve 24 is closed and carriage 18 is pulled back. The friction of the percussive tool on the bore hole wall is sufficient to develop adequate tension in the drill string to telescope the valve assemble into its closed position. Valve spool 36 moves axially with rspect to valve body 38 until keys 76 engage the ends of axial grooves 54 in valve spool 36 so that radial passage 50 is covered by wear rings 74 thus closing the valve. In this configuration the valve will be structurally sound enough to transmit the maximum pulling capability of the drill frame to the percussion tool in the event it must be retracted from the bore hole. The carriage assembly is released from the end of the drill string and withdrawn along track 19. Another section of drill pipe is inserted and the process is repeated.

The above described preferred embodiment of the invention is for purposes of illustration. Various modifications will be apparent and the invention is defined only by the following claims.

I claim:

1. In a boring tool assembly having an underground percussion mole boring tool powered by a working fluid, said tool being driven through the earth by a rigid drill string pushed by a drilling frame, and a downhole valve assembly fixed between the downhole end of said drill string and said tool, the improved downhole valve assembly comprising:

a valve spool having an open first end, a closed second end and a peripheral sidewall, an axial bore extending partly through said valve spool from said open first end;

a radial passage adjacent said closed second and of said valve spool, said radial passage extending radially from said valve spool axial bore through said valve spool peripheral sidewall;

an axial groove in said peripheral sidewall of said valve spool;

a valve body having a first end, a second end and a peripheral sidewall, an axial bore extending through the valve body, said valve spool extending through said valve body axial bore so that said second end of said valve body is adjacent said closed second end of said valve spool, said valve spool being axially moveable within said valve body axial bore;

an axial slot through said peripheral sidewall of said valve body, said axial slot positioned adjacent and mating with said valve spool axial groove, and said valve spool axial groove extending axially beyond said valve body axial slot;

a free-floating key element fitting within said valve spool axial groove and said valve body axial slot, said key element having an axial extent less than the axial extent of said valve spool axial groove so that said key element allows said valve spool limited axial movement within said valve body;

a valve housing, said housing having an axial bore therethrough and a peripheral sidewall, said valve body extending through said housing axial bore, said housing peripheral sidewall covering said valve body axial slot to thereby retain said free-floating key element within said valve body axial slot;

seal means for closing said radial passage in said valve spool when said second end of said valve spool is moved axially towards said first end of said valve body so that working fluid entering said open first end of said valve spool axial bore is effectively prevented from passing out of said valve spool, and for opening said radial passage when said second end of said valve spool is moved axially towards said second end of said valve body so that working fluid entering said open first end of said valve spool is permitted to pass through said radial passage into the axial bore of said valve body and out of said second end of said valve body.

2. A boring tool assembly as recited in claim 1 wherein said valve body has an end piece forming the second end of said valve body and wherein said axial bore in said second end of said valve body provides a radial clearance from said valve spool.

3. A boring tool assembly as recited in claim 1 wherein said seal means comprises a wear ring fixed within said axial bore of said valve body.

* * * * *